United States Patent [19]

Klapp

[11] 4,237,677

[45] Dec. 9, 1980

[54] SWITCHING APPARATUS FOR THE LOWERING AND PIVOTING RAILS OF A CARTON FILLING MACHINE

[75] Inventor: Hartmut Klapp, Kaarst, Fed. Rep. of Germany

[73] Assignee: Jagenberg-Werke AG, Dusseldorf, Fed. Rep. of Germany

[21] Appl. No.: 22,136

[22] Filed: Mar. 20, 1979

[30] Foreign Application Priority Data

Jun. 12, 1978 [DE] Fed. Rep. of Germany ..... 2825647

[51] Int. Cl.[3] ..... B65B 5/10; B65H 29/14

[52] U.S. Cl. ..... 53/505; 53/244; 53/534; 192/143; 200/61.42; 271/200; 271/214; 271/DIG. 3; 414/107

[58] Field of Search ..... 271/200, 201, 198, 184, 271/214, 256, 263, DIG. 3; 53/542, 244, 259, 246, 248, 249, 250, 251, 505, 534; 93/93 DP, 93 HT; 198/604, 626, 607, 594, 812, 502; 414/107, 109, 110, 900; 200/61.41, 61.42; 192/143, 138, 131 R

[56] References Cited

U.S. PATENT DOCUMENTS

| | | | |
|---|---|---|---|
| 3,698,707 | 10/1972 | Lucas | 271/201 X |
| 3,825,106 | 7/1974 | Wickam et al. | 198/572 |
| 3,932,982 | 1/1976 | Klapp | 271/184 X |
| 4,057,243 | 11/1977 | Fujimoto | 271/256 |

*Primary Examiner*—Bruce H. Stoner, Jr.
*Attorney, Agent, or Firm*—Sughrue, Rothwell, Mion, Zinn and Macpeak

[57] ABSTRACT

Switch apparatus for the positioning drive of a lowering and pivoting rail for the guiding of blanks into transport containers in a carton filling machine. With the pivoting rail and the aid of a belt running along the pivoting rail, previously imbricated delivered blanks are delivered to loading position in the transport container such as a carton. The lowering rail serves as a counter support so that the pivoting rail and lowering rail cooperate at the loading point of the blanks to guide and control the loading of the blanks as far as possible into their final position in the transport container.

5 Claims, 2 Drawing Figures

SWITCHING APPARATUS FOR THE LOWERING AND PIVOTING RAILS OF A CARTON FILLING MACHINE

BACKGROUND OF THE INVENTION

During a position change or exchange of transport containers, the lowering rail and the pivoting rail in a carton filling machine of this type are removed from the container in unison by means of a connecting linkage and are then moved back into the transport container. As the lowering and pivoting rails are moved back into the transport container it is important that the downwardly projecting lowering rail opposite the pivoting rail be held as precisely as possible but with a predetermined space from the floor of the transport container or a previously loaded layer of blanks so as to avoid hinderance to the lowering rail during loading due to something such as protruding floor flaps of the carton.

SUMMARY OF THE INVENTION

A basic object of the invention is the provision of a switch apparatus of the above-described type which makes possible rapid and precise stopping of the lowering and pivoting rails during their movement into the transport container in such a manner that a predetermined minimum distance is maintained above the floor of the transport container or the previous layer of blanks while the lowering rail is simultaneously brought as close as possible to the floor of the transport container or the surface of the previous layer of blanks.

This object is attained in accordance with the invention with the provision of a switch rail on the generally vertically movable lowering rail which projects downward beyond the lowering rail and which can be shifted along the pivoting rail. This switch rail is held in position by a permanent magnet and a bridge against the force of a spring in the lowermost, extended position in such a manner that an end switch activated by the bridge remains closed and is opened when the switch rail contacts the floor of the transport container or a layer of blanks. This opening is effected quite abruptly when the bridge is separated from the permanent magnet.

When the switch rail projects toward the rear, the bridge abuts the permanent magnet. The weight of the switch rail and the retaining force exerted by the permanent magnet are sufficient to hold the switch rail against the force of the spring in the extended position. As the lowering and pivoting rails are moved into the transport container, as soon as the switch rail contacts the floor of the transport container or a previously loaded layer of blanks, continuing movement of the lowering rail causes the bridge to separate from the permanent magnet. The retaining force of the permanent magnet with regard to the bridge and switch rail then suddenly decreases with the result that the force of the spring becomes dominant. In this manner, by the effect of the spring, the switch rail is pulled into its upper retracted position and the end switch connected with the bridge is abruptly opened. The opening of the end switch halts a hydraulic drive of the lowering and pivoting rails. The abrupt upward movement of the switch rail is advantageously limited by a stop on the lowering rail.

It is also desirable to arrange a capturing spring on the machine frame against which a stop bolt on the switch rail rests during the raising of the lowering rail during its exit from the transport container in such a manner that the switch rail is brought back into the lowermost, extended position. Thus the lowering and pivoting rail is ready for a new introduction into the transport container with the final position of the lowering and pivoting rail being precisely controlled.

In a preferred embodiment of the invention, the switch rail has a return stroke of about 30 mm and the lower rail together with the switch rail remains about 15 mm above the floor of the transport container or layer of blanks. This assures that the lowering rail passes far enough into the transport container to guarantee a properly guided loading of the blanks and a proper functioning unhindered by floor flaps and the like.

BRIEF DESCRIPTION OF THE DRAWINGS

An exemplary embodiment of the invention is illustrated in the drawings and is described in greater detail below.

DESCRIPTION OF THE PREFERRED EMBODIMENTS

Figure 1:
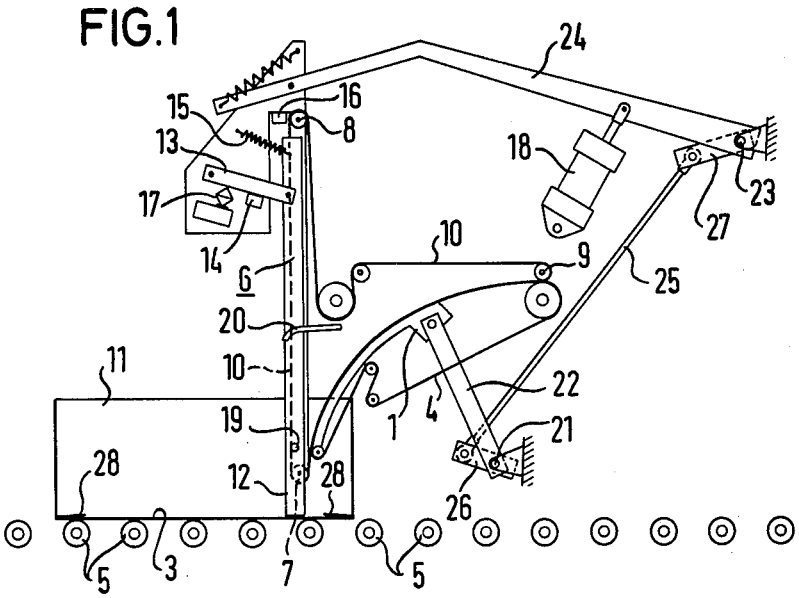
FIG. 1 is a schematic side view of a lowering and pivoting rail with an extended switch rail in the position at which it contacts the container floor.

The lowering and pivoting rail mechanism illustrated in the drawings includes a pivoting rail 1 by means of which blanks 2 are transported to the floor 3 of a carton 11 with the aid of lower belt 4. Carton 11 is movable on rollers 5. A lowering rail 6 is also provided. An upper belt 10 runs along pivoting rail 1 up to a lower roller 7 of lowering rail 6 then further to an upper roller 8 of lowering rail 6 and from there back to a roller 9 on the input side of the pivoting rail 1. Blanks 2 are securely guided between lower belt 4 and upper belt 10 until they reach the loading point in carton 11.

A switch rail 12 is provided on the lowering rail 6 which can be shifted along lowering rail 6 and which projects from the lower end thereof beyond lowering rail 6. In the downward extension of switch rail 12 as shown in FIG. 1, a bridge 13 between lowering rail 6 and switch rail 12 abuts a permanent magnet 14 which is attached to lowering rail 6. A spring 15 acts against the holding force of the permanent magnet 14 and against the weight of the switch rail 12 but is not sufficient to overcome the sum of these forces.

Figure 2:
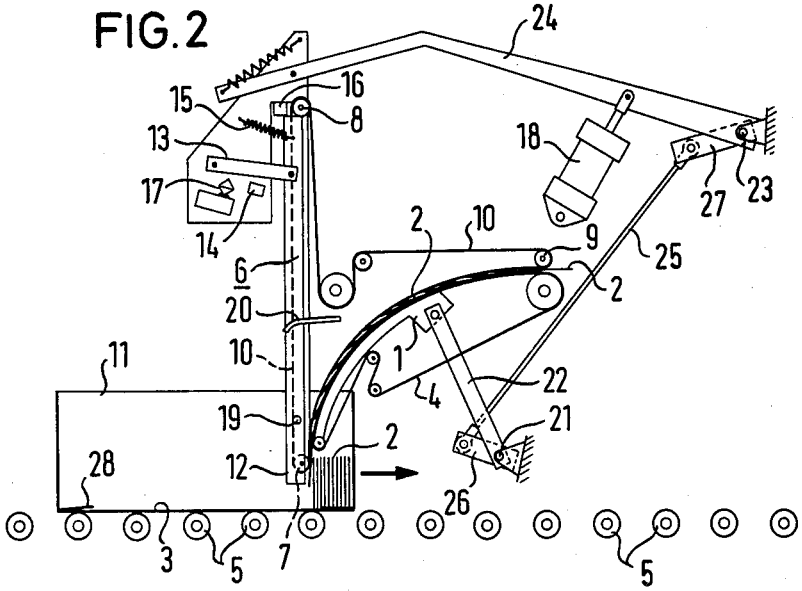
FIG. 2 is a side view similar to FIG. 1 in which the positioning drive of the lowering and pivoting rails has been turned off and released by the abrupt retraction of the switch rail.

As soon as the switch rail 12 contacts the floor of carton 11 or a layer of blanks 2, bridge 13, which is made of a ferromagnetic material, is mechanically released from the permanent magnet 14. This decreases the holding force with which bridge 13 is pulled against permanent magnet 14 as a result of the suddenly appearing air space between the two. At this point, the force of spring 15 is now the dominant force so that switch rail 12 is abruptly pulled upward to a stop 16. Because of the sudden upward movement of switch rail 12, an end switch 17, which was previously closed by bridge 13, is also opened abruptly stopping the hydraulic drive from cylinder 18 which acts upon lowering and pivoting rails. The lowering and pivoting rail mechanism is thereby halted in the position shown in FIG. 2. As the mechanism is raised from this position, a stop bolt 19 on switch rail 6 strikes against a stationary capturing spring 20 so that switch rail 6 is extended and bridge 13 comes into contact with permanent magnet 14. The switch apparatus is then ready for the next insertion operation.

The positioning drive of the lowering and pivoting rail mechanism operates in the following manner. Pivoting rail 1 is attached to a lever 22 which is rotatable about a point of rotation 21. Lowering rail 6 is attached to a lever 24 which is pivotable about a point of rotation 23. Levers 22 and 24 are connected to one another by means of a connecting rod 25 and to lever shoulders 26 and 27 for common pivoting about their respective points of rotation 21 and 23. An extension of cylinder 18 effects an upward pivoting of lever 24 which thereby raises lowering rail 6. Lever 22 is simultaneously pivoted to the right and thus pivoting rail 1 is pivoted out of the carton. The introduction of the lowering and pivoting rail mechanism takes place in the reverse order in accordance with the depth detection and position control of switch rail 12. This control assures that lowering rail 6 together with switch rail 12 cannot be hindered in their operation by a floor flap 28 or the like of the carton 11.

What is claimed is:

1. Switch apparatus for the positioning drive of a lowering and pivoting rail means of a carton filling machine for guiding blanks into a transport container, the pivoting rail being pivotally movable into the container and supporting lower belt means, the lowering rail being generally vertically movable into the container and supporting upper belt means, the blanks being guided and delivered into said container between the lower and upper belt means, comprising:

a switch rail mounted adjacent said lowering rail, and movable with respect to said lowering rail in a generally vertical up and down movement, said switch rail projecting downwardly into said container beyond said lowering rail into a lowermost, extended position as said lowering rail is moved into said container;

an end switch fixed to said lowering rail;

a permanent magnet fixed to said lowering rail;

a bridge fixed to said switch rail and abutting said end switch and said permanent magnet in the lowermost position of said switch rail with respect to said lowering rail;

a spring mounted between said lowering rail and said switch rail, said bridge and permanent magnet holding said switch rail against the force of said spring wherein said end switch is activated by removing said bridge out of abutment with said end switch, said end switch remaining closed until being abruptly opened when said switch rail contacts one of the floor of said container and a layer of blanks, whereby said bridge is removed from contact with said permanent magnet.

2. The switch apparatus according to claim 1, further comprising a hydraulic drive connected to and acting upon said lowering rail, the opening of the end switch halting said hydraulic drive.

3. The switch apparatus according to claim 1, further comprising stop means on said lowering rail for limiting abrupt upward movement of said switch rail.

4. The switch apparatus according to any one of claims 1, 2 or 3, further comprising:

a capturing spring arranged on a frame of said carton filling machine; and a stop bolt on said switch rail, said stop bolt striking said capturing spring as said lowering rail is raised in such a manner that said switch rail is returned to its lowermost, extended position.

5. The switch apparatus according to any one of claims 1, 2 or 3, wherein said switch rail has a stroke of approximately 30 mm with respect to said lowering rail and said lowering rail together with said switch rail is stopped approximately 15 mm above one of the floor of a transport container and a layer of blanks upon activation of said end switch.

* * * * *